United States Patent [19]

Hunt et al.

[11] Patent Number: 4,885,904

[45] Date of Patent: Dec. 12, 1989

[54] DRAWING MACHINES

[75] Inventors: Robert J. Hunt, Lisburn; Kenneth F. Crockard, Bangor, both of Northern Ireland

[73] Assignee: James Mackie & Sons Limited, Belfast, Northern Ireland

[21] Appl. No.: 245,277

[22] Filed: Sep. 16, 1988

[30] Foreign Application Priority Data

Sep. 18, 1987 [GB] United Kingdom ..... 8722062

[51] Int. Cl.[4] ..... D01H 7/24; D01H 7/40

[52] U.S. Cl. ..... 57/67; 57/68; 57/71; 57/267

[58] Field of Search ..... 57/67, 66, 68, 71, 74, 57/267, 271, 352, 354, 115; 19/236, 288

[56] References Cited

U.S. PATENT DOCUMENTS

| | | | |
|---|---|---|---|
| 2,896,394 | 7/1959 | Johnson | 57/67 |
| 3,357,170 | 12/1967 | Pfeifer | 57/67 X |
| 3,432,891 | 3/1969 | West | 19/288 X |
| 4,015,416 | 4/1977 | Mori et al. | 57/67 X |
| 4,022,007 | 5/1977 | Motobayashi et al. | 57/352 X |
| 4,313,299 | 2/1982 | Günkinger et al. | 57/267 |
| 4,350,007 | 9/1982 | Gasser et al. | 57/315 X |
| 4,426,836 | 1/1984 | Novak et al. | 57/67 X |
| 4,757,679 | 7/1988 | Marzoli | 57/267 |

*Primary Examiner*—Donald Watkins

*Attorney, Agent, or Firm*—Oliff & Berridge

[57] ABSTRACT

A drawing machine having a drawing zone (8) for drawing silvers (2), and a plurality of flyers (14) for winding the silvers on to bobbins (16), is made compact by arranging the flyers substantially longitudinally of the paths of the silvers through the drawing zone, e.g. in echelon formation with respect to the silver paths.

10 Claims, 12 Drawing Sheets

DRAWING MACHINES

FIELD OF THE INVENTION

This invention relates to drawing machines and, in particular, to sliver packaging machines, that is to say drawing machines in which sliver from a drawing head is wound with a very slight twist on to large flanged bobbins in preparation for subsequent stages of drawing and spinning, instead of being fed to cans as has been traditional in the past. The sliver is given a very small degree of twist to provide sufficient cohesion for handling purposes. Although, strictly speaking, such twist converts the sliver into rove, the terms "sliver" and "rove" are used without distinction in the present specification to define the same basic material. The use of large bobbins instead of cans has many advantages. The invention is concerned with a number of inventive features involved in the production of such wound bobbins; these features can be used in combination or independently of one another.

INFORMATION DISCLOSURE

FIG. 1 of the accompanying drawings shows in plan view a conventional sliver packaging machine in which feed slivers 2 are taken from cans 4 on a creel 6 to a drawing zone 8 to be combed and drafted. The drawing zone 8 is virtually completely under cover and the slivers are drafted between feed rollers (hidden by the cover) and drawing rollers 10 from which they pass to delivery rollers 12. Slivers from separate cans may be combined to pass as one through the drafting zone; for example, twelve slivers may be fed in pairs to provide six slivers. From there, the slivers are delivered to flyers 14 where they are wound with a slight twist on to large bobbins (e.g. having a wound diameter of approximately 20 cm by 38 cm long, and a weight of approximately 7 kg). The flyers 14 lie in a row transverse to the length of the drawing zone.

The faller gill bed of the drawing zone need only be wide enough to accommodate the slivers which are fairly closely spaced, and it is advantageous to restrict the width of the drawing zone as much as practicable. However, because of the large diameter of the bobbins and the associated flyers, the span of the row of flyers greatly exceeds the width of the drawing zone (e.g. by a factor of three). Therefore, as the drafted slivers emerge from the delivery rollers 12, at least the outermost slivers must be deflected from the line which they have been following through the drawing zone and fan out to their respective flyers 14. For this purpose, the slivers pass along tubes or conductors 13 of varying lengths and angles. Deviation from the straight line path has an adverse effect on the slivers, which at this stage are normally completely untwisted, as it can cause false drafting. Furthermore, sliver friction against the wall of the tube or conductor can result in a build-up of static electricity which, in turn, can cause tangled fibres and slubs in the sliver, even to the extent of blocking the tube and breaking the sliver.

SUMMARY OF THE INVENTION

The overall purpose of the invention is to produce a high quality sliver on a drawing machine which has its own flyer winding apparatus to wind the drawn slivers on to the large flanged bobbins referred to and to reduce the manual labor and time required in operating the machine and doffing and donning the bobbins.

The present provides various novel features, not all of which are claimed herein. However, this invention relates to each and every novel feature herein, alone or in combination with any other features, novel or otherwise.

According to a primary feature of the present invention, flyers in a drawing machine are arranged in a direction generally longitudinal of the paths of the slivers through the drawing zone. The necessary spacing between the flyers is obtained, without the need for lateral spacing substantially greater than that between adjacent slivers in the drawing zone. As a result, and particularly when there is one flyer per sliver, the slivers can follow substantially parallel, straight line paths from the delivery rollers to just above the flyers, thus avoiding or significantly reducing the disadvantages just referred to. In addition, the machine is rendered considerably less wide, and therefore more compact than known machines, since the total transverse span of the complete row of flyers need not be substantially greater than the width of the drawing zone.

DESCRIPTION OF THE INVENTION

Preferably, the flyers are arranged in echelon formation, that is to say with the first flyer in the row closest to the delivery rollers and each successive flyer spaced progressively further from the delivery rollers so that a straight line drawn through the flyers makes an acute angle with the paths of the slivers. Other formations are possible, however. For example, an arrowhead formation can be used, that is to say with a central flyer spaced furthest from the delivery rollers and flyers on either side of it spaced progressively closer to the delivery rollers. As a further alternative, the flyers can be divided into groups, each in an individual echelon formation. In each case, the spacing between adjacent flyers is obtained primarily in a longitudinal direction, thus reducing the lateral spread of the flyers, as already explained.

Another feature of the invention which contributes to the compactness of the machine lies in the provision throughout the drawing zone of dividers which separate adjacent slivers and which preferably converge towards one another at their downstream end so as to reduce migration of the fibres as they pass from the fallers to the drafting rollers. This enables the spacing between adjacent slivers to be reduced without any increase in the migration of fibres. In order to accommodate these dividers, the fallers may be constructed with unpinned sections to coincide with the pitch of the dividers.

In order to facilitate automatic threading of the slivers, and to support them, they may pass through guide tubes or conductors which may be in the form of tubes, leading to the respective flyers, each of which may have a pair of flyer feed rollers. Beneath the flyer feed rollers, a cylindrical or otherwise tubular guide may extend down the flyer to a rove layer which guides the sliver on to the surface of the bobbin. The flyer may have a false twister at the input end of its tubular passage or may be provided with sliver support means, such as are described in GB-A-1282001, along the axis of its bearing support.

According to a further feature of the invention, the sliver guide down the leg of the flyer is enclosed or substantially enclosed, preferably tubular, and follows a sinuous path which assists in binding the fibres of the sliver together since, as already mentioned, the sliver has only minimal twist. The leg of the flyer may be hollow and shaped so as to provide a sinuous path for the sliver, so that the leg itself forms the sliver guide. Preferably the guide is fully enclosed from entrance to exit, but it may have a fine slot or small apertures to give access, if required, to the sliver.

The rove layer may also be tubular, so that the sliver is effectively totally enclosed between the sliver feed rollers and the surface of the bobbin. The rove layer is pivoted, in order that it can move from an initial position in contact with or close to the surface of the barrel of the bobbin to a position in which it is clear of the surface of the sliver when the bobbin is fully wound. Preferably, the rove layer has a biasing mechanism which automatically causes it to snap into one or other of its two extreme positions as it approaches that position. In other words, at the start of winding, as the rove layer is moved inwardly, it automatically snaps into position in engagement with or close to the barrel of the bobbin, from which position it is gradually moved outwardly as the sliver builds up on the bobbin. Similarly, as the bobbin approaches the fully wound condition, the biasing mechanism causes the rove layer to snap into its outermost position in which it is clear of the surface of the sliver on the bobbin.

Another important feature of the invention is concerned with the operation of the mechanism for traversing the sliver along the length of the bobbin during winding. The actual traversing motion is provided by a conventional cam, for example a heart cam, which produces a steady motion from one end of the bobbin to the other and back, with a slight dwell at each end caused by the tip of the cam and the diametrically opposite recess. This produces a rocking movement in a pivoted lever of which one end is connected to a belt or chain which passes over an idler pulley, the other end of the belt or chain being connected to the bobbin carriage so that the latter reciprocates with the traversing lever.

In accordance with this feature of the invention, the pivot of the traversing lever or the pivot mounting is automatically adjustable between a position at which normal winding occurs and at least one other position in preparation for doffing. Preferably, the traversing lever is pivoted to a bracket which is formed as a nut for movement along a vertical screw which, during normal traversing movement, is stationary. When the required length has been wound on the bobbin, an automatic control decelerates the speed of the machine and eventually stops it with the bobbin carriage in its lowest winding position. At this point, the sliver is wound around the topmost part of the barrel of the bobbin.

The automatic control then starts a further motor to drive the screw on which the bracket for the traversing lever is threaded and thus drives this downwardly, causing the traversing lever to pivot about its point of contact with the heart cam and to raise its opposite end, thus lowering the bobbin carriage below its lowest traversing position and then stopping it in a position in which the rove layer of the flyer is opposite the top flange of the bobbin or an extension thereof which is constructed so as to retain the tail of the sliver. Preferably, the flange is formed with a converging groove so that a few turns of sliver are wound in the groove, after which rotation of the bobbin is stopped. Alternatively, for example, an extension above the flange may have a textured surface so as to cause the sliver to adhere to it.

The next step in the automatic control is to turn the bobbin in the reverse direction sufficiently to create a slackness in the sliver between the end of the rove layer and the bobbin. Downward movement of the bobbin carriage under the control of the traverse lever then resumes until the bobbin carriage reaches the doffing position, the sliver being broken in the process.

As just described, the bobbin carriage is lowered for doffing purposes until it rests on a transfer mechanism, preferably in the form of a pair of toothed racks driven by respective gear wheels. According to a further feature of the invention, the transfer mechanism supports two bobbin carriages and when one carriage is moved laterally away from the flyers, the second carriage, complete with a set of empty bobbins, is moved into position beneath the flyers ready for the next cycle of operation. Instead of two bobbin carriages, the machine may have two sets of bobbin carriages, each set comprising a number of carriages, but, for convenience the specification will relate only to two carriages. The machine restarts, and the full bobbins are then doffed and replaced by empty bobbins. At the end of the next cycle, the transfer mechanism is moved in the opposite direction to bring the first carriage with the empty bobbins into position beneath the flyers and to move the second carriage with full bobbins laterally into a doffing position on the other side of the array of flyers.

As a consequence of this alternating movement of the transfer mechanism, bobbins are doffed alternately on opposite sides. Signalling means may be provided which operate in accordance with the direction of movement or position of the carriage. Preferably, each side includes a respective position sensor which is activated by the carriage when the doffing position is reached. This provides a signal to an overhead lifting mechanism comprising a motorized doffing and donning carriage running on gantry-like rails above the flyer mechanism. The signal from the position sensor causes the carriage to run on its rails to a position immediately above the bobbins, whereupon telescopic arms descend to grip the full bobbins and lift them off the spindles of the bobbin carriage and then to deposit them on a doffing support, e.g. in the form of a tray or conveyor. Having deposited the full bobbins, a set of empty bobbins is picked up from the same tray and then transferred to the empty bobbin carriage. At the end of the next cycle, the carriage carrying the full bobbins is transferred to the opposite side of the flyers, as already described, and operation of the position sensor on that side then signals the motorized doffing and donning carriage to move along its rails to a position above the newly-transferred bobbin carriage, after which the sequence is repeated.

During winding, each bobbin rests on a rotatable bobbin carrier which, on its underside, has a friction pad or ring which bears against the stationary spindle base to provide the necessary drag or winding tension. Owing to the considerable weight of the full bobbins and the relative shortness of the winding and doffing cycles, e.g. 15 minutes, a considerable amount of heat is generated as a result of the friction between each pad or ring and the spindle base. In the past, using lighter bobbins and longer cycles of operation, the heat accumulated in the spindle assembly has had time to disperse; with an arrangement in accordance with the invention, this is no longer the case.

In order to combat this, in accordance with yet a further feature of the invention, each spindle is mounted for rotation in the bobbin carriage and is provided with cooling blades or fins on the underside of its base, which suck in air when rotated. Drive is provided to each spindle so that, after the full bobbins have been doffed and preferably before they are replaced with empty ones, the spindles are rotated so that each assembly is rapidly air-cooled. Preferably, this is achieved by fitting each spindle with a toothed pulley engaged by a drive, preferably in the form of a toothed belt which is common to all the spindles and is driven in an enclosed loop by an electric motor. During the winding operation, the motor is stopped and braked so as to hold the spindles stationary, in the normal way, but as soon as the full bobbins have been doffed, the motor is automatically started so as to air-cool the spindle assemblies very rapidly.

DESCRIPTION OF THE DRAWINGS

A complete sliver packaging machine embodying all the various features of the invention just set forth will now be described in more detail, by way of example only, with reference to FIGS. 2 to 19 of the accompanying drawings, in which:

As seen in FIGS. 2 and 4, the flyers 14 are arranged in echelon formation away from the delivery rollers 12 (and drawing rollers 10); a line passing through the centers of the first and last flyers makes an acute angle with the path of the sliver back from any of the flyers to the delivery rollers, this angle being shown as $\alpha$ in FIG. 4. As illustrated, the slivers continue in straight line paths so that the transverse width of the array of flyers is equal to the width of the drawing zone. It is not essential that these two widths should be identical, but the width of the array of flyers should not be substantially greater than the width of the drawing zone, in order to ensure the advantages of a substantially straight line path. As already explained, echelon formation, as illustrated, is not essential; alternatives are possible.

Turning to FIG. 2 in more detail, the slivers 2 on leaving the drawing zone 8 are each assisted by so-called "airmovers" 18, only one sliver and its associated airmover being illustrated for simplicity. Airmovers are devices operated by compressed air and providing a flow of air around each sliver which reduces friction with any supporting surface and generally assists the onward passage of the sliver in question. On leaving the delivery rollers 12, further airmovers 19 direct the slivers into straight guide tubes or conductors 13 which increase in length in accordance with the distance between the delivery rollers and the respective flyers 14. Above each flyer is a pair of flyer feed rollers 20 and a further airmover 21 which feeds the respective sliver down into the neck portion 22 of its flyer 14. If desired, the flyer feed rollers may be positioned directly in line with the exit of the tube so as further to reduce any deflection in the sliver paths up to the feed rollers 20.

The airmovers are primarily used to feed the slivers to their respective flyers and bobbins when piecing up the ends, but they can also be used, continuously or intermittently, to provide a cushion of supporting air for the sliver during the operation of the machine. Any such use or requirement may depend on the type and quality of the sliver being processed.

Figure 3:
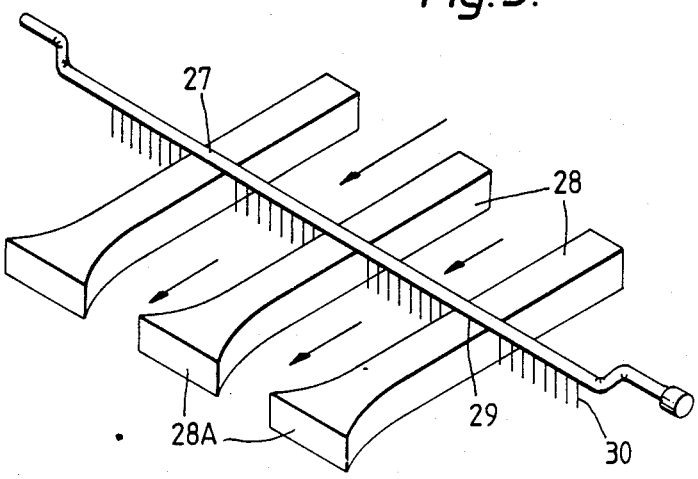
FIG. 3 is a diagrammatic representation of the drafting zone, showing only a single faller, for simplicity.

FIG. 3 is a diagrammatic showing of the drawing zone in which the slivers are indicated by arrows and are separated by dividers 28 which (as is preferred) converge towards each other at their downstream ends 28A, so as to reduce migration of the fibres as they pass from the faller gill bed to the drafting rollers. For simplicity, only a single faller 27 is shown. It will be seen that there are gaps (as at 29) in the pinning 30 of the faller 27, to accommodate the dividers 28. Each faller may be chain-driven or alternatively they may, for example, be screw-driven or of the push bar type. While it is in general important to include pin fallers in the drawing head, the invention relates more broadly to any type of drawing head such as is used, for example, in roller and apron drafting.

Figure 13:
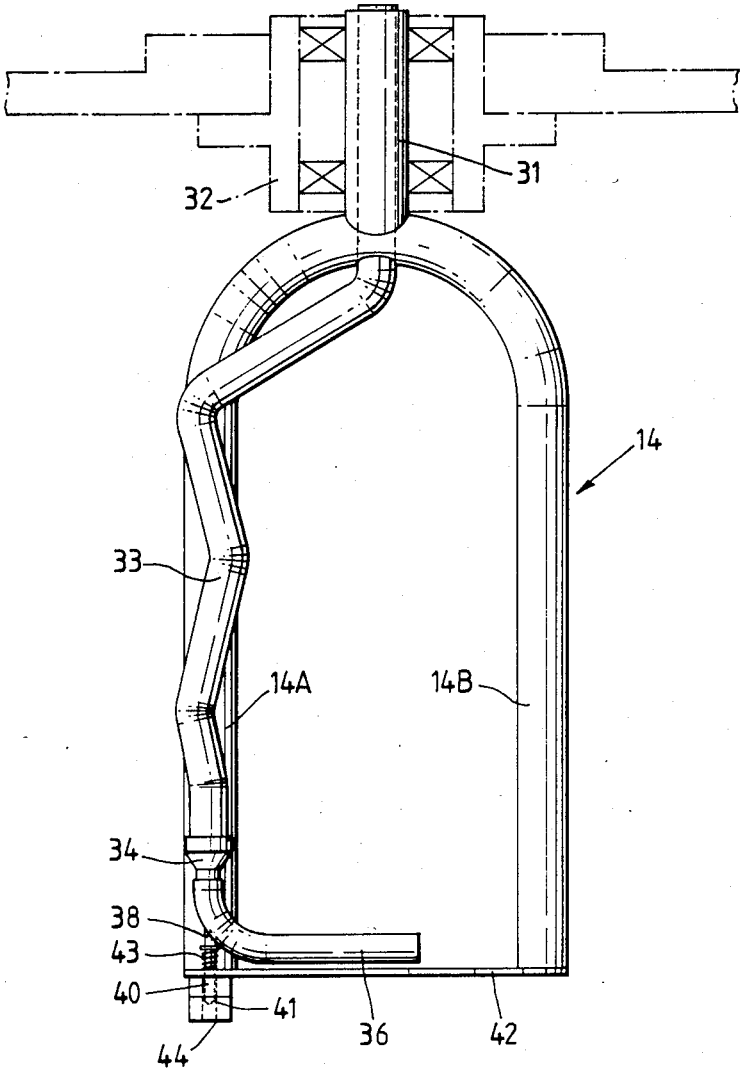
FIG. 13 is a side elevation of the flyer.

One of the flyers 14 is shown in FIG. 13; the flyer, which is mounted for rotation in bearings in a housing 32, has a tubular sliver guide 31. At the head of the flyer, the tube bends outwardly towards one of the flyer legs 14A (the other being 14B) and then zig-zags down the leg so as to form a sinuous path 33 for the sliver. The tube is formed at its lower end with a condenser 34 which co-operates with a tubular rove layer 36 which guides the sliver on to a bobbin. The rove layer is pivoted by means of a pin 38 which is fixed to the rove layer, and is located in a fixed boss 40 secured to the lower ring 42 of the flyer. A spring 43 both exerts torsional control in biasing the rove layer towards a bobbin barrel and also acts as a tension spring so as to force a collar 44 attached to the bottom of the pin 38 upwardly against the underside of the fixed boss 40. The underside of the boss 40 is formed with a V-shaped projecting ridge 41.

Figure 12:
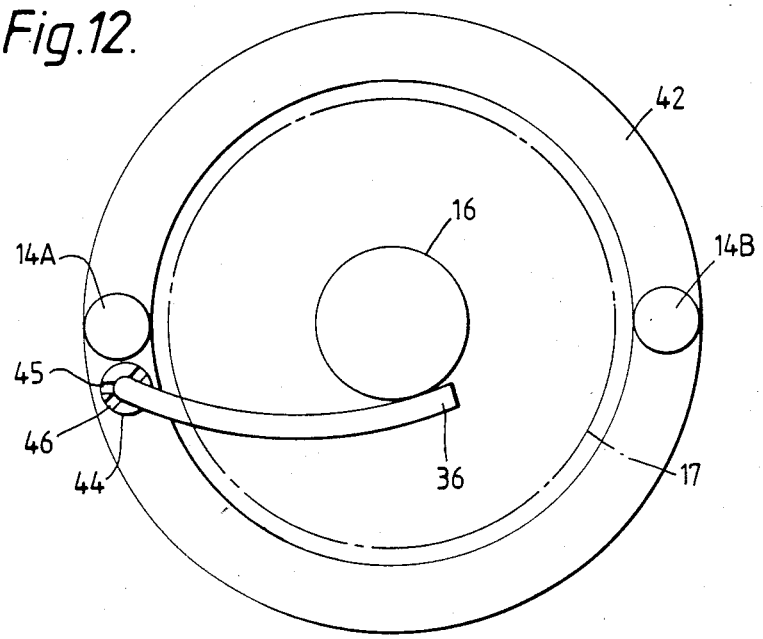
FIG. 12 is a plan view of the lower part of the bobbin and flyer shown in FIG. 9.

FIG. 12 shows V-shaped grooves 45 and 46 in the upper face of the collar 44, which correspond with the V-shaped ridge 41, and define limiting positions of the rove layer 36. The rove layer 36 is biased by the tension in the spring 43 which forces the ridge 41 into one or other of the grooves. When the ridge 41 is in engagement with the groove 46, the rove layer 36 takes up the position shown in FIG. 12 in which it is in contact with the barrel of the bobbin 16. As the package on the bobbin builds up, the rove layer is forced outwardly and the ridge 41 is thus forced out of the groove 46 against the bias of the spring 43. As the winding approaches completion, such that the diameter 17 of a full bobbin is reached, the ridge 41 approaches the groove 45 and, at this stage, the biasing effect of the spring causes the ridge 41 to snap into the groove 45, thus moving the rove layer away from the surface of the package just as winding is complete. The purpose of this will be explained later.

The purpose of the sinuous path down the leg of the flyer is to assist in binding the fibres of the sliver together as they are subjected to tension while being wound on to the bobbin. As already explained, the sliver is twisted only to an extremely slight extent, so that the drawing operations at the next processing stage, are not adversely affected. The sinuosity of the path helps to counteract the resultant lack of cohesion in the sliver. The principle of a sinuous path to improve the cohesion of a sliver is not new in itself, but not previously in conjunction with a completely or substantially completely enclosed path from the top to the bottom of a flyer, i.e. along the guide tube 31, through the condenser 34 and thence via the rove layer 36 to the surface of the package. This continuous path throughout the height of the flyer is of great importance in threading up the machine automatically at the beginning of an operational cycle, or when piecing-up a broken end.

Figure 4:
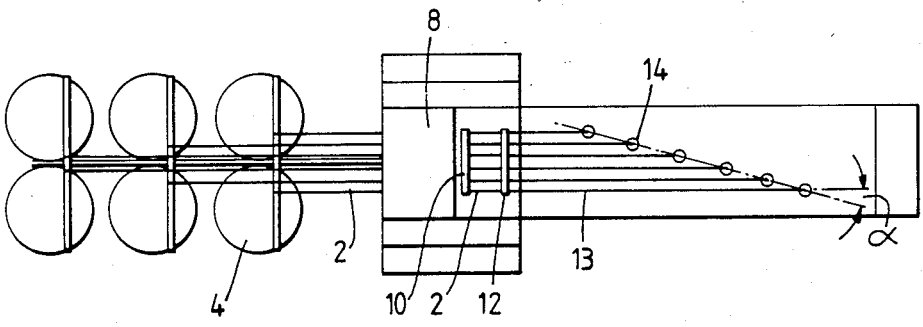
FIG. 4 is a plan view showing the paths of slivers through the machine.

At the start of operation, the slivers are fed from the cans 4 shown in FIG. 4 at the back of the machine into the nip of the back feed rollers and so to the drawing zone 8, by the machine operator. The machine is then started up to run slowly until the combed and drafted slivers pass from the drawing rollers 10 at the front of the drawing zone. It is at that point that the airmovers play an important role. Once the slivers have emerged from the drawing rollers 10, the operator need then only present them to their respective airmovers 18 (FIG. 2) which suck them in and project them to the nip of the delivery rollers 12. After passing through the delivery rollers, the slivers are drawn into their respective airmovers 19 which then feed them along the guide tubes 13 to the respective flyer feed rollers 20. From there they are then sucked into airmovers 21 which project them along the respective flyer guide tubes 22 and thence via the rove layers 36 to the surfaces of the barrels of the empty bobbins 16.

Figure 9:
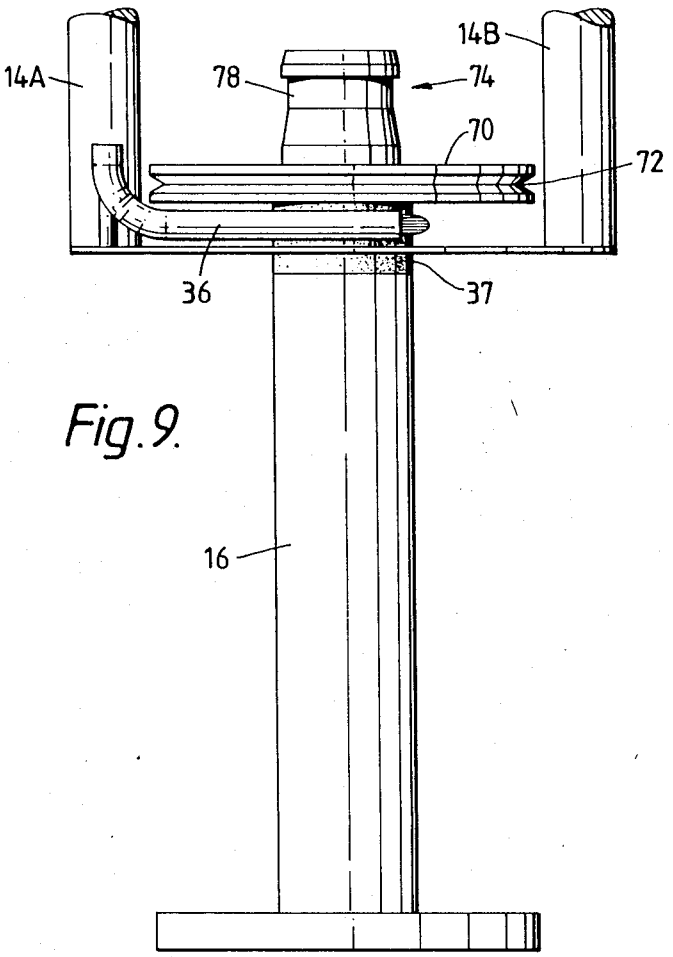
FIG. 9 is an elevation of an empty bobbin used in the machine, shown in relation to the lower part of a flyer, both in position for the start of a new winding cycle.

FIG. 9 shows one of the bobbins 16 in more detail. The bobbin has a top flange 70 including a converging groove 72. To facilitate doffing, as explained below, an extension in the form of a knob 74 having a groove 78 is provided above the flange 70.

At the start of winding, each rove layer 36 is located adjacent the upper end of the barrel of the bobbin 16, which is formed or provided with a textured surface 37. The sliver emerging from the rove layer therefore adheres to the barrel so that, after the first few wraps have been wound on to the bobbin, the machine can be accelerated to its normal operating speed. Each bobbin is mounted on a bobbin carrier which rotates on a spindle, as will be described in more detail later. The carriers are pulled around the axis of the spindle by the rove in the flyer as the flyer rotates; winding tension or drag is provided in the usual way by a friction pad or pads attached to the underside of the base of the bobbin carrier and resting under the weight of the bobbin against the base of the spindle.

Figure 6:
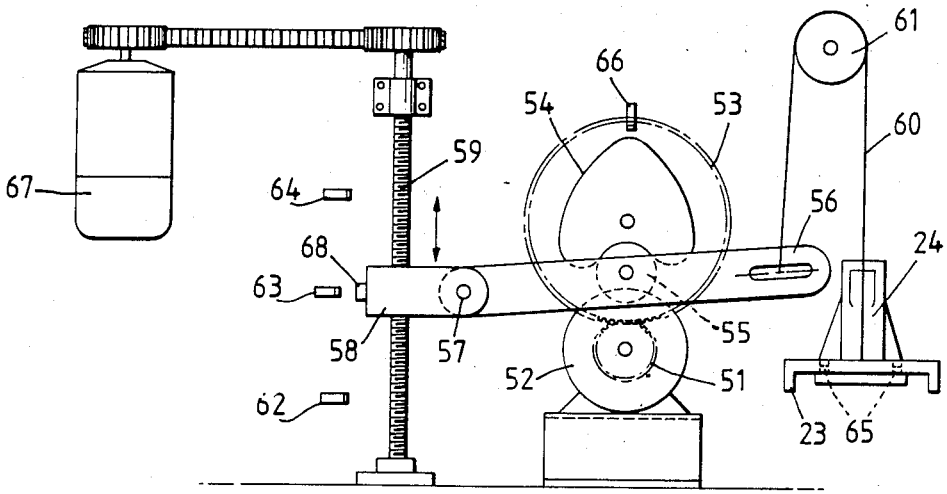
FIG. 6 illustrates the vertical drive to the bobbin carriages.

As the winding continues, the sliver needs to be traversed up and down the barrel of the bobbin; mechanism which causes the bobbin carrier rail to reciprocate upwardly and downwardly is illustrated in FIG. 6. The bobbins are supported on a carriage 23, the drive to which includes a conventional heart cam motion in which a gear wheel 51 on the shaft of a variable speed motor 52 drives a meshing gear wheel 53 on which the heart cam 54 is mounted. The heart cam, in turn, engages with a follower 55 which is mounted for rotation on a traverse lever 56 which is pivoted at 57 to a bracket 58 mounted for linear movement along a screw 59. During the normal winding operation, as the bobbin is being wound, the bracket 58 remains in a set position. At the end of the lever 56, opposite to its pivot, is connected a belt 60 which passes around a pulley 61 to a lifting bracket 24. The lifting bracket has locating studs 65 that locate in holes in the carriage which rests on the lifting brackets. Therefore, as the heart cam rotates, it pivots the traverse lever 56 so as to raise and lower the bobbin carriage 23. There are two lifting brackets 24, one at each end of the machine, and these are mounted on slide rods which ensure that there is no lateral movement of the bobbin carriage.

Figure 8:
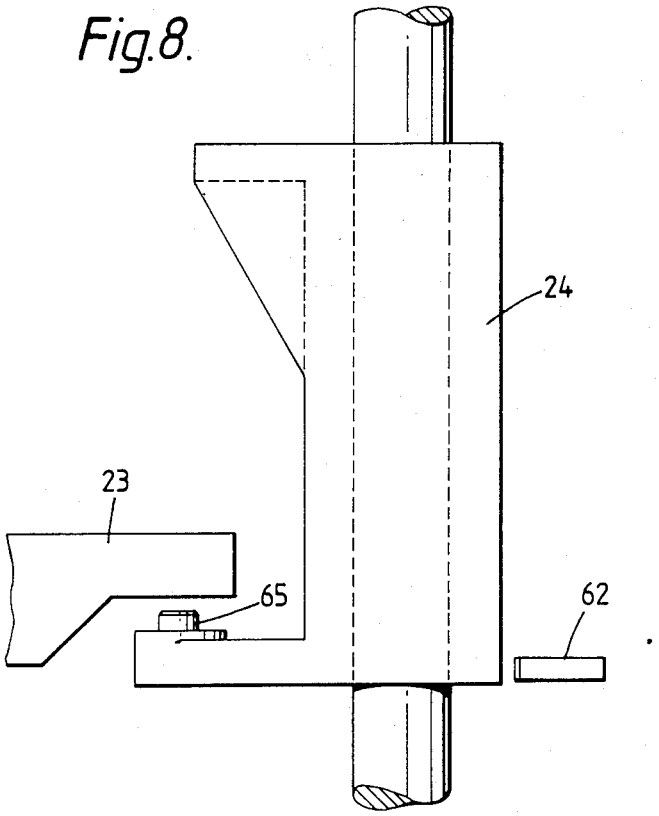
FIG. 8 shows a lifting bracket for a bobbin carriage.

FIG. 8 shows the lifting bracket 24 in greater detail. FIG. 8 shows also a lower proximity switch 62 which determines the bobbin doffing position of the bracket.

Figure 7:
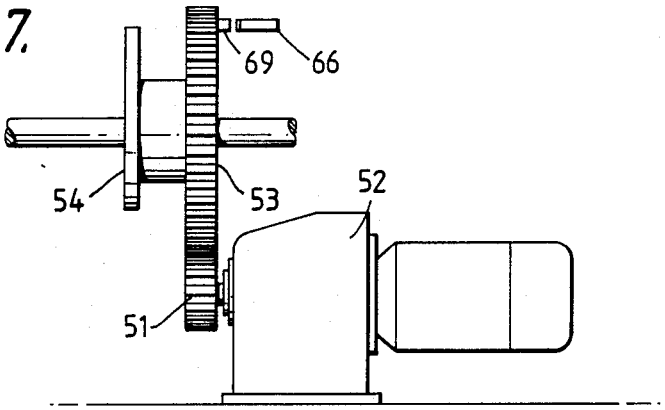
FIG. 7 illustrates part of the drive shown in FIG. 6.
Figure 19:
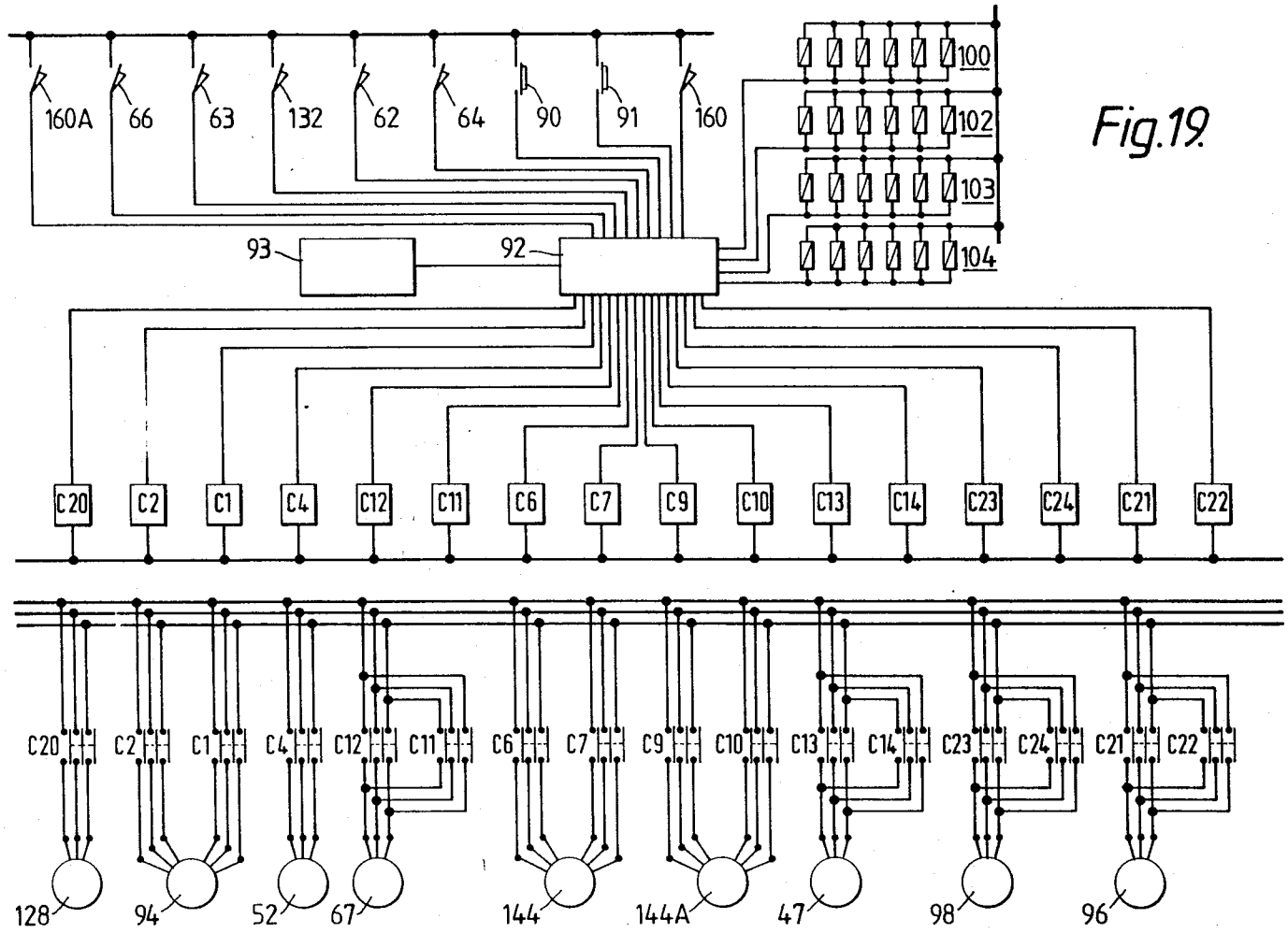
FIG. 19 is a circuit diagram for apparatus for use in controlling the machine.

When the required yardage has been wound on the bobbin, the machine as a whole is signalled to decelerate (e.g. by means of a yardage counter, microprocessor and a brake motor 94; see FIG. 19). When a positioner 69 (see FIG. 7) on the heart cam gear wheel 53 reaches a proximity switch 66, the brake motor 52 is signalled to stop, at which point the cam follower 55 is in the dwell of the heart cam and the bobbin carriage 23 is therefore in its lowest winding position wherein the sliver is wound around the bobbin at the topmost part of its barrel. The rest of the machine, which is driven independently of the brake motor 52 but which is synchronized with it, continues to decelerate.

Figure 10:
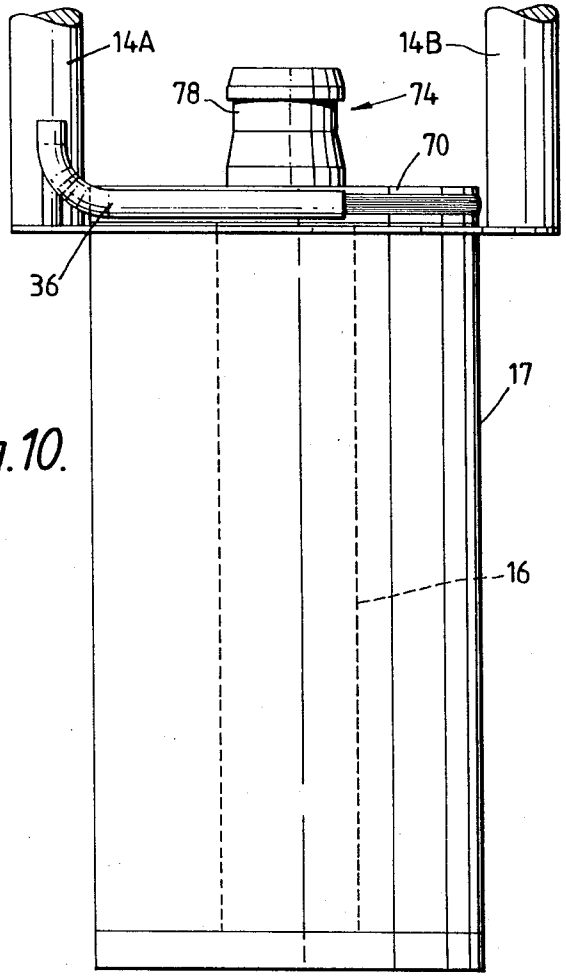
FIG. 10 shows a full bobbin after completion of the winding operation and with the sliver end tucked into the top flange.

The signal from the proximity switch 66 also starts a further brake motor 67 to rotate the screw 59 in a direction such that the bracket 58 which is threaded on to it is driven downwardly, the pivot end of the traverse lever 56 is lowered and its opposite end raised. This causes the lifting brackets 24 and bobbin carriage 23 to move downwardly below their lowest traverse position until a positioner 65 on the bracket 58 reaches a proximity switch 63 which signals the further brake motor 67 to stop at a point at which the rove layer 36 of the flyer is opposite the converging groove 72 in the top flange 70 of the bobbin 16 (see FIG. 10). The switch 63 also sends a signal to bring the brake motor 94, which drives the flyers through a P.I.V. box (134, see FIG. 16) to a halt after a few (predetermined) wraps of sliver have been wound around the groove in the bobbin flange, the shape of which causes them to lock into it.

Figure 11:
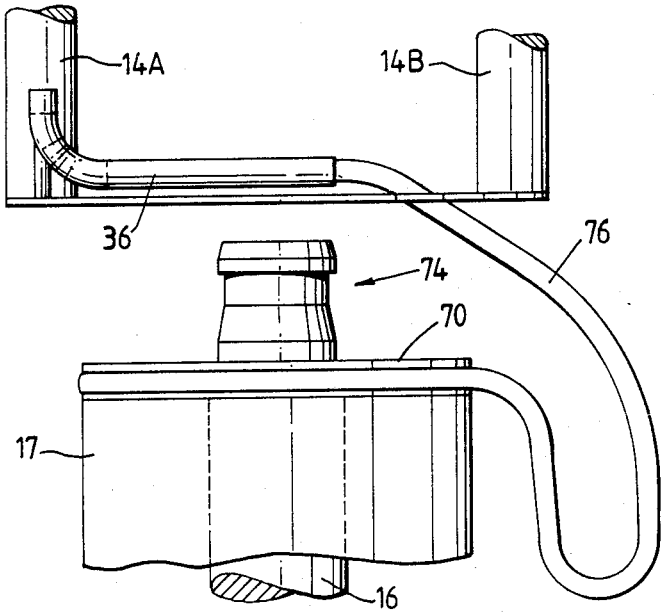
FIG. 11 shows the top portion of a full bobbin lowered to the doffing position.

As previously described, as the winding of a bobbin is complete, the groove 45 in the collar 44 ensures that the rove layer 36 is held away from the surface of the bobbin, in a position directly over the bottom flyer ring 42 which is clear of the largest diameter of the package. The rove layer is then locked in position. Soon after the flyer comes to rest with the wraps wound into the groove in the top flange of the bobbin, a time sequence triggered by the switch 63 through the micro-processor causes a motor 144 (FIG. 17) to operate. The bobbin is turned, in reverse, through a predetermined angle so as to unwind a short length of sliver from the groove in the top bobbin flange and, hence, create a slackness in the sliver between the end of the rove layer 36 and the bobbin. A motor 128 (see FIG. 16) then stops and simultaneously, in the predetermined controlled sequence, the motor 67 starts again to drive the screw 59 in the direction to lower the bracket 58 from the position illustrated in FIG. 6 opposite the switch 63 to the lower proximity switch 62 which determines the doffing position of the bobbins. At this position, the bobbin carriage 23 rests upon the doffing racks 25 (FIGS. 2 and 5) and the lifting bracket studs 65 are out of the locating holes in the bobbin carriage (see FIG. 8). In this position there is sufficient slackness in the sliver (as illustrated in FIG. 11) to enable the sliver to break easily during the doffing movement.

Figure 1:
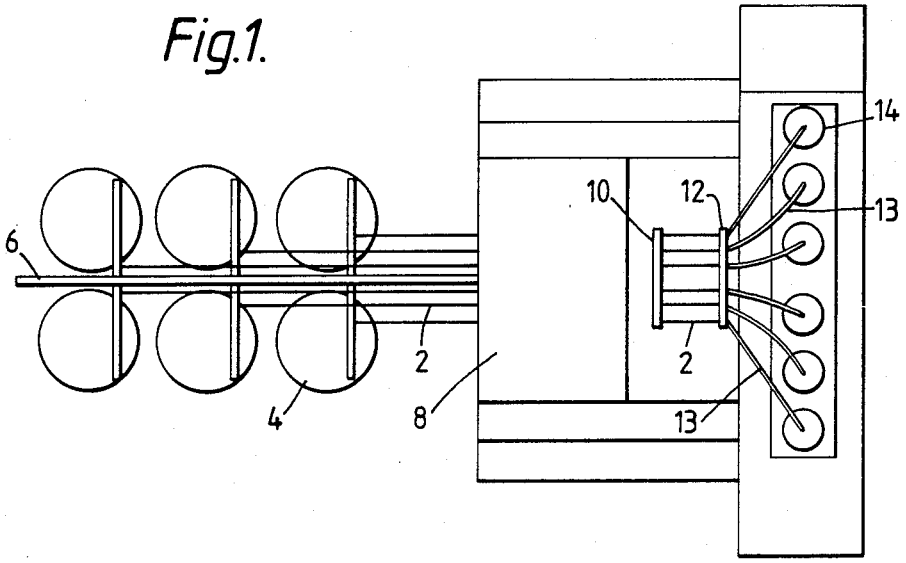
FIG. 1 has already been referred to as illustrating a conventional sliver packaging machine. Comparison with FIGS. 2 and 4 immediately brings out one major feature of the invention, namely that the slivers leaving the delivery rollers 12 continue along substantially straight line paths to the flyers 14. The disadvantages of the deflection of the slivers, as shown in FIG. 1, are thus avoided.
Figure 2:
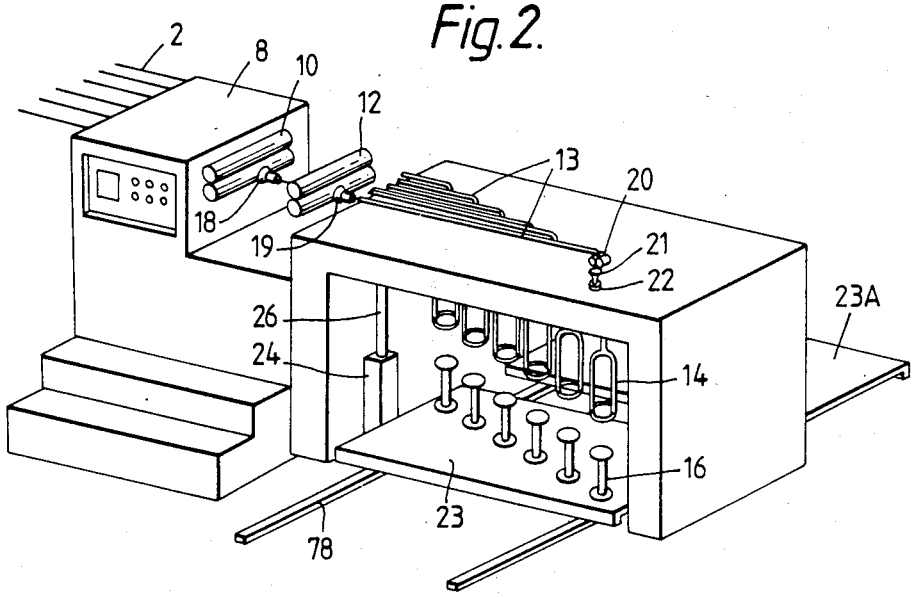
FIG. 2 is a general, diagrammatic perspective view of the whole machine.

The doffing of the full bobbins from beneath the flyers will now be described with particular reference to FIGS. 2, 4 and 5. In conventional arrangements for the handling of bobbin carriages on spinning machines, there is a rack on which the two sets of bobbin carriages can sit side-by-side. Bobbin lifter brackets are first raised to lift one set to the highest position underneath the flyers, and the rack is then moved inwardly so as to move the other set below and beyond the first set so that, during winding of the bobbins on the first set, the carriages, when traversing up and down, do not foul the tops of the empty bobbins on the second set. The rack is then moved outwardly again, the second set being held in the back position by pawls. When the bobbins on the first set are full, the lifter brackets are lowered until the carriage rests on the rack, whereupon the rack is moved outwardly from the flyers so as to move the first set with the full bobbins from underneath the flyers while at the same time moving the second set, with the empty bobbins, underneath the flyers. Another conventional method is to employ a rotary member instead of a rack, on which the two sets of carriage are seated side-by-side. The member is then rotated to bring one or other of the carriages, as required, under and in line with the flyers.

Figure 5:
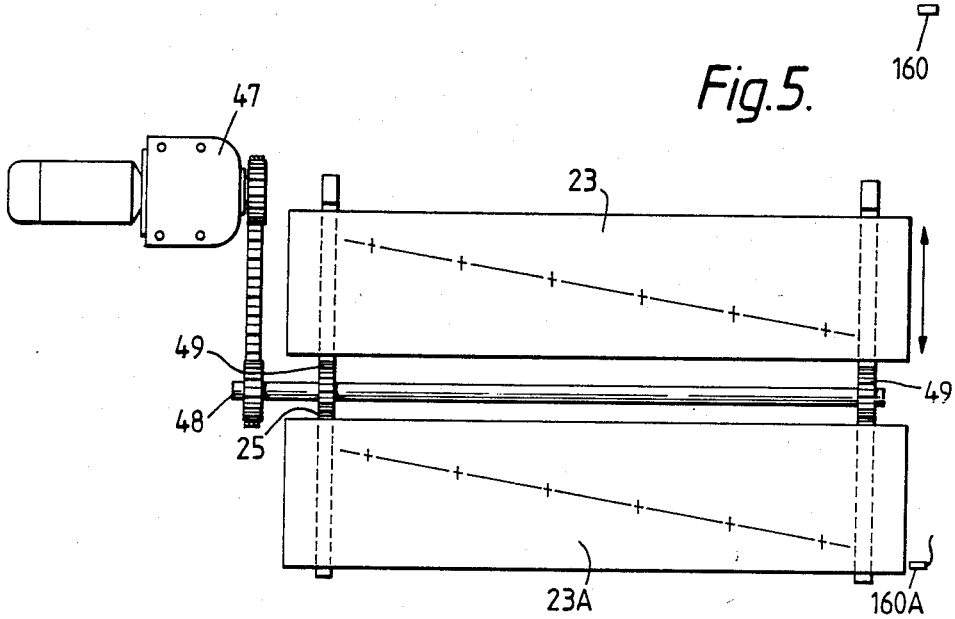
FIG. 5 is a plan view showing bobbin carriages for supporting bobbins to be wound.

As shown in FIG. 5, on a machine in accordance with the invention, toothed racks 25 are driven by way of a motor 47 which drives a shaft 48 carrying gear wheels 49 that engage the teeth in a rack 25 to move it, and hence the bobbin carriage with the full bobbins, from below the flyer to one side of the machine; there, it is unobstructed by the machine, enabling automatic doffing apparatus to lower on to the full bobbins, to rise, lifting the full bobbins off the spindles on the bobbin carriage, and to lower again in order to allow empty bobbins to be put on. However, to reduce the time taken for this operation the rack is arranged to be driven in both directions so that, at the end of one winding cycle, the bobbin carriages with the full bobbins are moved to the right-hand side of the machine (as seen in FIG. 2) and, in the next cycle, the full bobbins are moved to the left-hand side. In each instance, the carriage with the empty bobbins is moved underneath and aligned with the flyers. During the next winding cycle, the full bobbins are automatically doffed from the carriage at one or other side of the machine and replaced with empty ones in readiness for the next doff. In FIGS. 2 and 5, the carriage below the flyers is shown as 23 and that with the empty bobbins at the side of the machine as 23A.

One important point is that, during the movement of the full bobbins to the side of the machine, the slack in the rove 76 between the flyer and the bobbin (FIG. 11) is taken up and the rove draws apart, leaving the reserve wraps held in the groove of the top flange to facilitate piecing-up at the next processing stage, at which the bobbins will provide the supply source for drafting and spinning into yarn.

Figure 18:
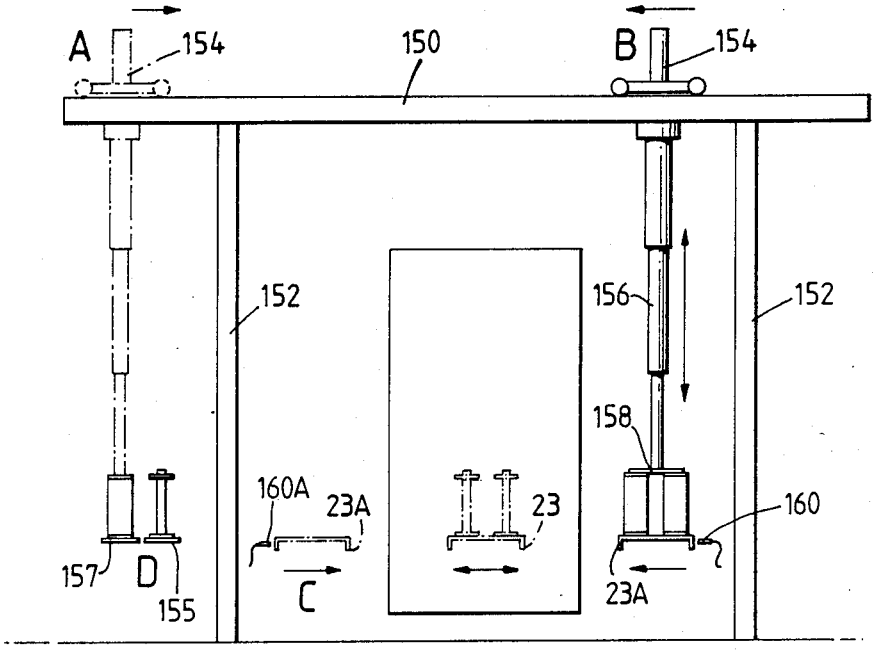
FIG. 18 is a diagrammatic illustration of the doffing mechanism.

FIG. 18 shows bobbin lifting apparatus which may be used in a machine in accordance with the invention for the doffing of the full bobbins and donning of the empty bobbins. The doffing of full bobbins from the displaced bobbin carriage can be effected at any time during the next winding cycle. There is no need for any delay in starting the next winding cycle once the full bobbins have been moved to the side of the machine and have been replaced by empty bobbins.

The doffing and donning apparatus (FIG. 18) comprises horizontal rails 150 which extend cross-wise above the machine and are supported by pillars 152. The rail supports a motorized carriage 154 on which a telescopic lifting arm 156 is mounted. At the bottom end of the arm 156, a pivotable support member 158 carries a row of grippers pitched to correspond with the bobbin carrier spindles. In its inoperative position, the carriage 154 sits at position "A" above a tray 155 having pitched spigots for holding empty bobbins and a conveyor 157 for removing full bobbins. As seen in FIG. 18, in which no flyers are shown, the full bobbins have been doffed to the right-hand side, and the empty bobbins on the bobbin carriage 23 are in the winding position. The two bobbins shown on the bobbin carriers represent the first and last bobbins in the echelon formation.

Most conveniently, when the carriage 23A arrives at the doffing position at the side of the machine, it operates a switch 160A (FIGS. 5 and 18) which sends a signal telling the motorized carriage 154 to which side of the machine the bobbins have been doffed. The carriage 154 then moves to that side, i.e. position "B" in FIG. 18, and the telescopic arm 156 descends to cause the grippers on the pivotable plate 158 to cover and grip the bobbin knobs 74. The arm then rises, lifting the full bobbins above the height of the machine, and the carriage 154 moves back across the rail 150 to position "A". During this time, the gripper plate pivots to move the bobbins from their echelon disposition, so that they are parallel with the conveyor 157 on to which the bobbins will then be lowered and released, before being conveyed away from the machine. The grippers are then raised so as to be at a height greater than the bobbins, the carriage 154 moves to cause them to be above the replacement empty bobbins on tray 155 at position "D", and the grippers lower and grip the empty bobbins and lift them up off the tray. The carriage then moves over to position "B" again, the gripper plate 158 pivots to the echelon alignment with the spindles on bobbin carriage 23A, and lowers so as to place the bobbins on the spindles in readiness for the next doffing cycle.

As will be appreciated, when the bobbin carriage 23 is doffed to the left-hand side of the machine, the movements of the carriage 154 are automatically programmed to accommodate the fact that the doffed bobbins will then be at position "C" which is closer to the conveyor 157 and tray 155. Again, the signal starting the motorized carriage is provided by a switch 160 at that side of the machine.

Novelty, with respect to this aspect of the apparatus, lies primarily in the feature of sensing means in the form of the switches 160 and 160A at each side of the machine. These signal the bobbin doffing apparatus so as to direct it to the appropriate side. This principle can be utilized independently of the type of bobbin doffing apparatus used.

Referring again to FIG. 6, when the bobbin carrier 23A with the full bobbins has been moved on the rack 25 (FIGS. 2 and 5) from underneath the flyers and replaced by the bobbin carrier 23 with the empty bobbins, activation of the switch 160, 160A signals the motor 67 to re-start, but this time in the opposite direction. The bracket 58 is therefore screwed up the screw 59, thus raising the pivoted end of the transverse lever 56 to pivot it about the follower 55, lowering the opposite end and raising the bobbin carriage 23. When the bracket 58 reaches the position of the proximity switch 64 the motor 67 stops, at which point the bobbin is in the start-up position, and the rove layer 36 (as see in FIG. 9) is opposite the textured surface at the top of the barrel of the bobbin but held in the "out" position over the bottom ring of the flyer due to the engagement of the V-cam projection 41 with groove 45 (FIGS. 12 and 13).

During the winding operation, the main drive to the machine is transmitted to the flyers 14 through the P.I.V. box 134 (FIG. 16) by toothed belts 118 and pulley 120. A drive shaft 122 is driven by a free-wheel unit 124 while running freely on a similar free-wheel unit 126. After the main drive has been stopped, a motor 128 is activated to turn the second free-wheel unit 126 slowly to drive the shaft 122 to the flyers, the shaft 122 now turning freely in the first free-wheel unit 124, so that only the flyers are driven and not the remainder of the machine.

Figure 15:
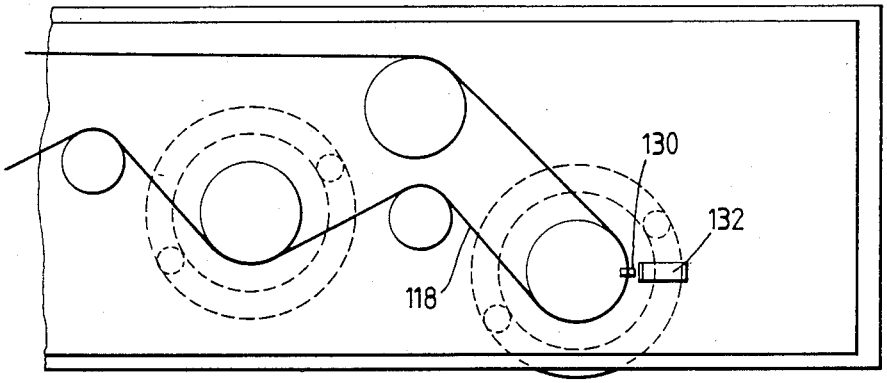
FIG. 15 illustrates positioning mechanism for rove layers on the respective flyers.

As shown also in FIG. 15, one of the flyer drive pulleys has a metal projection (positioner) 130 which, when it comes round to a sensor switch 132, causes the motor 128 to stop. This ensures that, before the doffing cycle commences, the flyers are all positioned with their rove layers in a predetermined position. They remain in that position until the full bobbins are moved to the doffing position at the side of the machine and have been substituted by the empty bobbins raised to the position as illustrated in FIG. 9.

Figure 14:
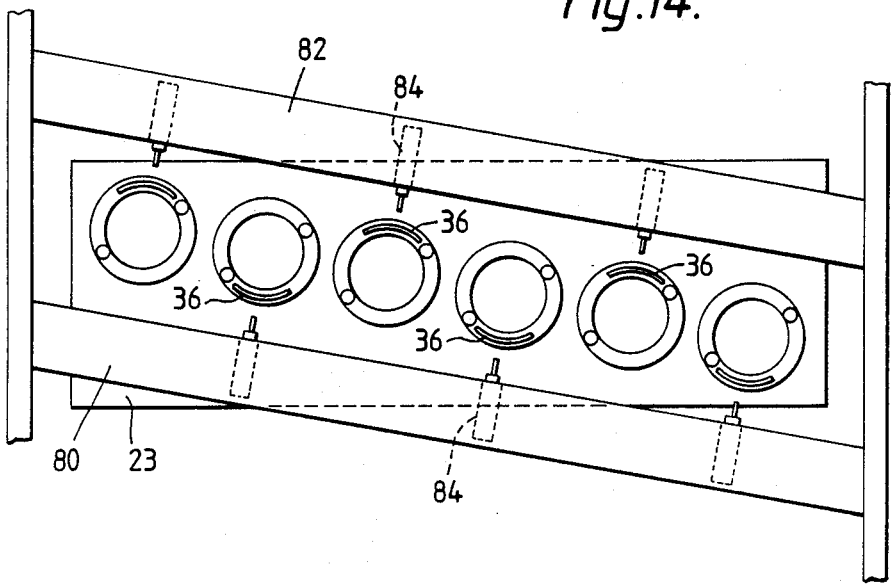
FIG. 14 is a plan view of a bobbin carriage with the flyers in the doffing position.

FIG. 14 shows the predetermined position: the rove layers 36 on alternate flyers are on opposite sides. This has the effect of equalizing any small out-of-balance loads caused by the provision of the flyer tube on one leg of the flyer.

FIG. 14 also shows rails 80 and 82 parallel to the line of the bobbins, and on which are positioned air cylinders 84 aligned with the rove layers 36 on the flyers. The rove layers are locked in their "out" position away from the barrel of the bobbin, as previously described. The cylinders 84 are automatically operated when the bobbin carriage again reaches the start-up position shown in FIG. 9 by a signal sent from the proximity switch 64 to a solenoid (100, see FIG. 19) so that the cylinder pistons strike the pivotable rove layers 36 and force the cam projection 41 out of the groove 45. The spring bias pivots the cam projection 41 inwardly until it is adjacent the empty barrel of the bobbin, at which point it clicks into the groove 46 to ensure that the rove layer is pushed against the barrel of the bobbin in readiness for start-up without need of operator assistance. The sliver is assisted through the flyer guide tube 33 and pivoted rove layer 36 on start-up of the machine by the airmover 21 (FIG. 2).

Figure 17A:
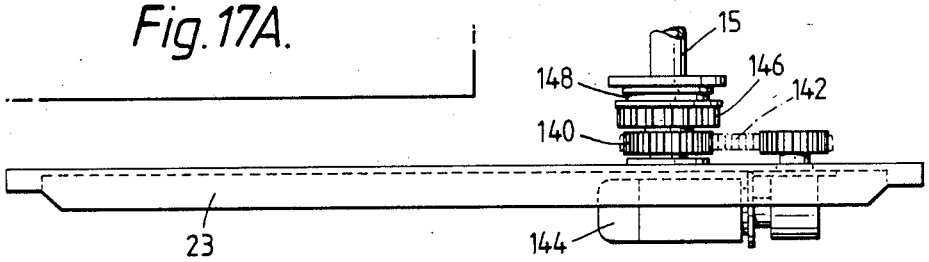
FIGS. 17A and 17B are associated elevation and plan views respectively of the bobbin carriage and illustrate spindle, cooling mechanism.
Figure 17B:
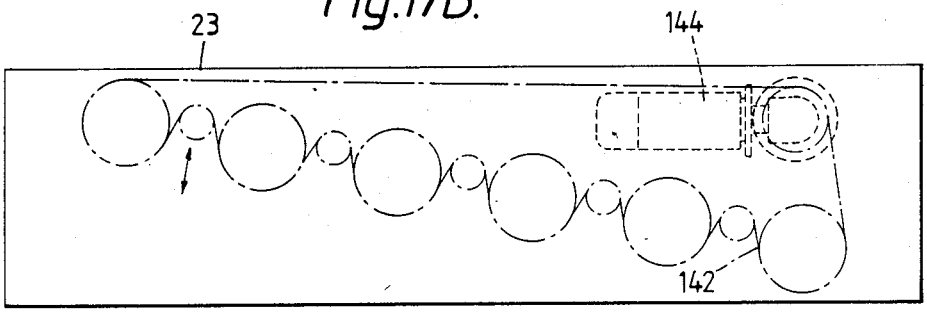

As already mentioned, and as shown in FIG. 17A, the large heavy bobbins are supported on rotatable bobbin carriers 148, the undersides of which have friction pads or rings to provide the necessary drag against the stationary spindle base. Owing to the weight of these bobbins, and the comparatively short time between doffs, much more heat is generated than on conventional machines, and this is transmitted to the spindle assembly. The short intervals between winding cycles do not allow sufficient time for the heat to dissipate and, as a result, the effect is cumulative. Accordingly, as shown in FIGS. 17A and 17B, each spindle is fitted with a toothed pulley 140 and is mounted for rotation in bearings (not shown) in the bobbin carriage 23. The bobbin carriage also carries a brake motor 144 which drives all the spindles through a common toothed belt 142. During the winding operation of the machine, the motor is stopped and braked so as to maintain the spindle stationary and thereby provide the required drag. Each spindle is provided with appropriately shaped cooling blades or fins 146, on the underside of its base, which suck in air when rotated. After the full bobbins have been doffed from the spindles and before they are replaced by empty ones, the motor 144 is automatically started so as to air-cool the spindle assemblies rapidly.

Figure 20:
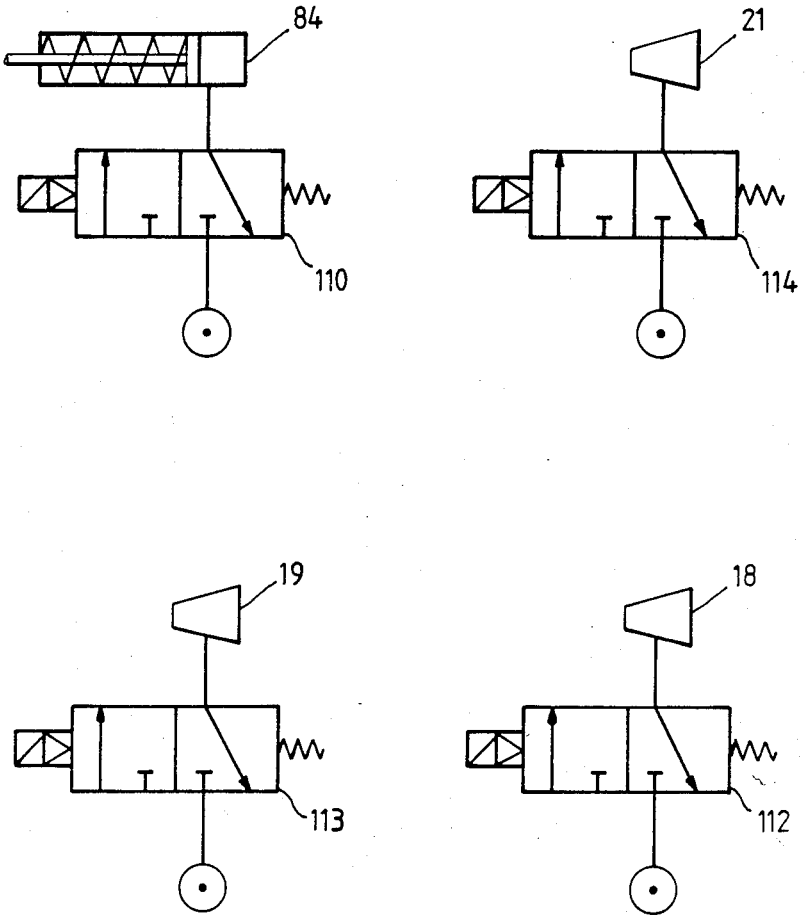
FIG. 20 shows electro-pneumatic connections used in the same control.

FIG. 19 shows the circuit diagram, and FIG. 20 pneumatic connections, which have been used in controlling the operation of a machine according to the invention. The operation (which to some extent duplicates the information given above) and control sequence steps are as follows:

1. The thread-up sequence is initiated by pressing a push-button 90 which causes an input signal to be sent to a microprocessor 92 which then sends an output voltage to contactor Cl. Motor 94 is started at slow speed and the slivers 2 are moved through the drawing zone to the drawing rollers 10. Also on receipt of the signal from push-button 90, the microprocessor outputs voltages to solenoids 102, 103 and 104 of 3-port spring return pneumatic valves 112, 113 and 114 (see FIG. 20) which open and cause airmovers 18,19 and 21 to start sucking. FIG. 20 shows only one of each type of valve, but a bank of a number, e.g. 6, of such solenoids, valves and airmovers, the same number as the number of slivers, is used in practice.

2. The airmovers 18 (one per sliver), at the downstream side of the drawing rollers 10, suck in the slivers 2 and forward them to the delivery rollers 12 which feed the slivers to the respective airmovers 19 which suck them in and forward each sliver along a respective enclosed conductor (tube) to feed rollers 20. Feed rollers 20 pass the slivers to respective airmovers 21 positioned above the neck portions 22 of flyers 14 which suck in the slivers and forward them down the tubular neck portions of the flyers and down the enclosed flyer leg guide 33 and along the tubular rove layer 36 of each flyer, to the barrel of the respective bobbin 16 which has a textured surface so as to cause the sliver to cling to it.

3. A push-button 91 is then pressed to start normal operation, thereby sending a signal to microprocessor 92 which then stops outputting voltages to solenoids 102, 103 and 104 of 3-port spring return valves 112, 113 and 114, which then close and so cause airmovers 18, 19 and 21 to stop sucking. This is the end of the thread-up sequence.

4. The microprocessor then outputs a voltage to contactor C2, causing a motor 94 to accelerate so as to run the machine at the predetermined winding speed, and to contactor C4, to start the brake motor 52 and cause the bobbin carriage 23 to traverse.

5. When a predetermined length (yardage) has been wound on to the bobbins, as measured by a yardage counter 93, a signal is sent to the microprocessor 92. On receipt of this signal, the microprocessor stops outputting a voltage to contactor C2 and so causes the brake motor 94 which drives the machine to decelerate. This is the end of the winding sequence and the start of the auto-doff sequence.

6. The microprocessor then waits until it receives a signal when the proximity sensor 66 (FIGS. 6 and 7) senses a positioner 69 on the point of the heart cam gear wheel 53. The microprocessor then stops sending an output voltage to contactor C4 and so stops the brake motor 52 (which drives the heart cam 54) so as to stop the traverse of the bobbin carriage 23 at its lowest winding position.

7. Also on receipt of the signal from the yardage counter 93, and after a pre-programmed brief interval, the microprocessor outputs a voltage to contactor Cl to cause the motor 94 to drive the machine at slow speed.

8. The proximity sensor 66 also signals the microprocessor 92 to output a voltage to contactor C12 to start the further brake motor 67 so as to rotate the screw 59 to drive a threaded bracket 58 downwardly to lower pivot 57 of the traverse lever 56 (FIG. 6), this causing the bobbin carriage 23 to move down below its lowest traverse position.

9. When the positioner 68 on the bracket 58 reaches the proximity sensor 63, a signal is sent to microprocessor 92 to stop outputting a voltage to contactor C12, and so causes the brake motor 67 to stop with the rove layers 36 in line with the groove 72 in the top flange 70 of the respective bobbins.

Figure 16:
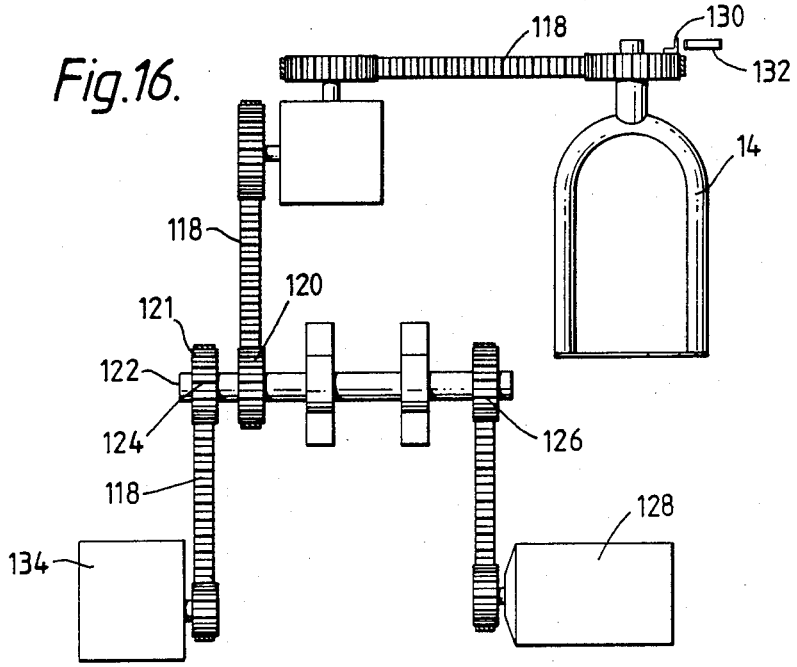
FIG. 16 illustrates the drive to one of the flyers.

10. Also on receipt of the signal from sensor 63, the microprocessor stops outputting a voltage to contactor C1 and so causes the brake motor 94 to stop the machine after the flyers have wound a few turns of sliver into the grooves of their respective bobbins. It should be noted that the brake motor 94 drives the flyers through PIV Box 134 (FIG. 16).

11. After a preprogrammed brief pause, the microprocessor outputs a voltage to contactor C20 so that the motor 128 is started to turn slowly the freewheel unit 126 and hence drive shaft 122 which drives only the flyers.

12. When a flag positioner 130 comes into line with a sensor switch 132 (FIG. 15), a signal is sent to the microprocessor 92 which responds by stopping the output voltage to contactor C20 so as to stop motor 128 and hence all the flyers in predetermined positions adjacent air cylinder 84.

13. After a pre-programmed short pause, and depending on whether the microprocessor is in receipt of a signal from a sensor 160A or 160 (FIG. 18) respectively, the microprocessor sends an output voltage either to contactor C7 or to contactor C10, which causes a brake motor 144 (FIG. 17) or a brake motor 144A to operate to rotate the spindles and bobbin carriers 148, on which the bobbins are mounted, in the reverse direction to winding. A short length of sliver is thus underwound from the grooves 72 in the bobbin flange, to create a slackness in the sliver between the end of the rove layer and the bobbin. (Motors 144 and 144A respectively drive the bobbins in the two bobbin carriages 23 and 23A. Sensors 160 and 160A respectively detect whether bobbin carriage 23 or 23A is in the doffing position).

14. After a pre-programmed interval, the microprocessor stops outputting a voltage to the contactor C7 (or C10), so causing motor 144 (or 144A) to stop.

15. Simultaneously with step 14, the microprocessor outputs a voltage to contactor C12 which causes the motor 67 to restart and to lower the bracket 58 from the position opposite sensor 63 to the position opposite sensor 62 which determines the doffing position of the bobbins. On receipt of a signal from the sensor 62, the microprocessor stops outputting a voltage to contactor C12, thereby stopping the motor 67.

16. Also on receipt of the signal from sensor 62, and depending on whether the microprocessor is in receipt of a signal from sensor 160A or 160, the microprocessor outputs a voltage to a contactor C13 or C14, which causes motor 47 to start and drive a shaft 48 and a rack 25 on which the bobbin carriages 23,23A rest. The bobbin carriage 23 or 23A with the full bobbins is thus moved from below the flyers (the slivers between them and the bobbins being broken in consequence) to one or other of the two sides of the machine. At the same time, the carriage 23A or 23, respectively, with the empty bobbins, is moved into place below the flyers. On receipt of a signal from the other sensor 160 or 160A, as the full bobbin carriage 23 or 23A reaches the doffing position, the microprocessor stops outputting a voltage to contactor C13 or C14 and so stops motor 47 (FIG. 5).

17. Also on receipt of the signal from sensor 160 or 160A, the microprocessor outputs a voltage to contactor C23 which starts a motor 98 (illustrated only in FIG. 19) and drives the bobbin lifting device 154 across the top of the machine to the side where the bobbin carriage with the full bobbins has been moved.

The operation of the bobbin lifting device 154 during the remainder of the auto-doff sequence in doffing the full bobbin and donning the empty bobbins is not claimed as part of this invention; the full circuitry for this can be readily devised but is not included herein. Briefly, however, a further motor 96 (FIG. 19 only) which drives the bobbin lifting device in a vertical direction is started and stopped via contactors C21 and C22, to drive it upwards and downwards, and a contactor C24 is used to start and stop motor 98, to drive the bobbin lifting device 154 horizontally in the opposite direction to that using contactor C23 mentioned previously. The whole sequence whereby the full bobbins are removed from, and empty bobbins are placed on, the bobbin carriage in the doffing position is controlled by the microprocessor in the manner in which it is pre-programmed to respond to signal receipts from various sensors etc. (not shown).

Empty spindles on that bobbin carriage in the doffing position are rotated in order to cool them before empty bobbins are located on the carriers. This is achieved via contactor C6 or C9, to cause motor 144 or 144A to rotate the spindles at high speed.

18. During step 17 and as a separate part of the auto-doff sequence, also on receipt of the signal from sensor 160 or 160A, the microprocessor outputs a voltage to contactor C11 to cause motor 67 to restart in the opposite direction, so as to drive bracket 58 up the screw 59. When bracket 58 reaches sensor 64, a signal is sent to the microprocessor which then stops outputting a voltage to contactor C11, causing the motor 67 to stop, at which point the bobbins are in the appropriate position for the start of the next winding cycle.

19. Also on receipt of the signal from sensor 64, and before the machine is restarted, the microprocessor outputs a voltage to solenoids 100 of a three-port spring return valve 110 (see FIG. 20), to operate the air cylinders 84, so that the cylinder pistons strike the pivotable rove layers 36 and move them to engage the barrels of the bobbins.

20. After a pre-programmed interval, the microprocessor stops outputting a voltage to solenoids 100, thereby closing the valves 110 and retracting the cylinder pistons to their inoperative position, clear of the flyers.

21. The microprocessor then returns to step 4 above and proceeds as before in the next winding cycle.

We claim:

1. A drawing machine comprising:

drawing means for drawing a plurality of slivers;

a plurality of flyers positioned downstream of the drawing means for positioning the slivers for winding;

guide means for establishing a path for the slivers from the drawing means to the flyers; and mounting means for mounting the flyers in an array spaced longitudinally along the sliver path.

2. A machine as in claim 1 wherein the guide means defines a plurality of parallel paths for the slivers.

3. A machine as in claim 2 wherein the mounting means positions the flyers in an echelon formation with respect to the parallel sliver paths.

4. A machine as in claim 2 wherein the guide means defines straight paths for the sliver from the drawing means to the flyer positions.

5. A machine as in claim 1 wherein the longitudinal extent of the array of flyers taken in a direction parallel to the direction of the guide means is greater than the transverse extent of the array taken in a direction perpendicular to the guide means.

6. A machine according to claim 1, which further comprises dividers that separate adjacent slivers as they pass through the drawing zone.

7. A machine according to claim 6, in which adjacent dividers converge toward one another at their downstream ends.

8. A machine according to claim 1, wherein the guide means comprises substantially enclosed conductor guides arranged to support the slivers between the drawing means and the positions of the flyers.

9. A machine according to claim 8, which comprises pneumatic means adapted to feed the slivers along the conductor guides.

10. A machine according to claim 1, in which each flyer is formed with an enclosed or substantially enclosed passage for sliver.

* * * * *